United States Patent [19]

Lund

[11] Patent Number: 4,670,112

[45] Date of Patent: Jun. 2, 1987

[54] PROCESS FOR PREPARING P-AMINO PHENOLS BY ELECTROLYSIS

[75] Inventor: Henning Lund, Risskov, Denmark

[73] Assignee: Farmaceutisk Laboratorium Ferring A/S, Vanlose, Denmark

[21] Appl. No.: 882,921

[22] PCT Filed: Nov. 21, 1985

[86] PCT No.: PCT/DK85/00108

§ 371 Date: Mar. 20, 1986

§ 102(e) Date: Mar. 20, 1986

[87] PCT Pub. No.: WO86/03194

PCT Pub. Date: Jun. 5, 1986

[30] Foreign Application Priority Data

Nov. 22, 1984 [DK] Denmark ..... 5537/84

[51] Int. Cl.[4] ..... C25B 3/00

[52] U.S. Cl. ..... 204/74

[58] Field of Search ..... 204/74; 564/415, 416

[56] References Cited

U.S. PATENT DOCUMENTS

| | | | |
|---|---|---|---|
| 1,542,265 | 6/1925 | Norris et al. | 562/453 |
| 1,882,758 | 10/1932 | Britton | 564/415 |
| 3,645,864 | 2/1972 | Lawson et al. | 204/74 |

FOREIGN PATENT DOCUMENTS

| | | | |
|---|---|---|---|
| 2256003 | 6/1973 | Fed. Rep. of Germany | 204/74 |
| 1421118 | 1/1976 | United Kingdom | 204/74 |

OTHER PUBLICATIONS

D. E. Danly, *Emerging Opportunities for Electroorganic Processes,* Marcel Dekker, Inc., New York, 1984.

*Primary Examiner*—John F. Niebling

*Assistant Examiner*—Ben Hsing

*Attorney, Agent, or Firm*—Fleit, Jacobson, Cohn & Price

[57] ABSTRACT p-Amino phenols of the formula

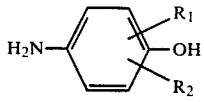

(I)

wherein $R_1$ nd $R_2$ are independently hydrogen, optionally substituted alkyl, halogen, COOH, $SO_3H$ or $NO_2$, are produced by electrolytic reduction of p-phenylazophenols of the formula

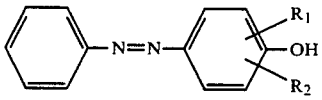

(II)

wherein $R_1$ and $R_2$ are as defined above, in an aqueous basic medium at a pH value at least equal to the pKa value of the p-phenylazophenol and at a temperature of at least 50° C., preferably 70° to 100° C.

The compounds (I) can hereby be produced without problems, in particular of an environmental nature, which are associated with the chemical reducing methods.

The process is particularly useful for the preparation of the compound 5-aminosalicylic acid which is a valuable active component of certain medicaments for the treatment of colitis ulcerose and Crohn's disease.

6 Claims, No Drawings

PROCESS FOR PREPARING P-AMINO PHENOLS BY ELECTROLYSIS

The present invention concerns a process for the preparation of p-amino phenols of the general formula I set forth in the introductory protion of claim 1, by electrolytic reduction of p-phenylazophenols in an aqueous medium, and the process of the invention is characterized by performing the electrolytic reduction in a basic medium at a pH value at least equal to the pKa value of the p-phenylazophenol and at an elevated temperature of at least 50° C. and preferably about 70° to 100° C. In this process, e.g. the compound 5-aminosalicylic acid may be conveniently obtained, said compound being a valuable active component in certain medicaments, cf. the PCT Application No. 81/02671, for the treatment of colitis ulcerose and Crohn's disease.

Arylazophenols of the general formula $$Ar—N{=}N—Ar'—OH$$

wherein Ar and Ar' are optionally substituted phenyl groups, can be produced by coupling a diazoted aromatic amine (an arylidiazonium compound) with a phenol in a basic medium (H. E. Fierz-David & L. Blangley: Grundlegende Operationen der Farbenchemie, 5th ed., Vienna 1943). This known coupling reaction has been used for many years in the production of dyes. The reaction is as follows:

$$ArNH_2+[NO^+]\rightarrow ArN^+{\equiv}N+H_2O \quad (1)$$

$$ArN^+{\equiv}N+Ar'OH+2OH^-\rightarrow Ar—N{=}N—Ar'O^-+H_2O \quad (2)$$

Arylazophenols can be reduced electrolytically in an acid medium to amines and amino phenols. The reaction can either take place directly (see e.g. Chem. Abstr., 13, 843 (1919) and Chem. Abstr., 15, 839 (1921)) or indirectly (see J. F. Norris & F. O. Cummings, Ind. Eng. Chem., 17, 305 (1925) and the U.S. Pat. No. 1,542,265). However, such a reaction is difficult to carry out with a good yield in practice since the arylazophenol is sparingly soluble in an aqueous acid, unless it contains an $HSO_3$ group or an $NR_2$ group in which the two R groups are the same or different and represent hydrogen or alkyl. It has been attempted to use an alcoholic hydrochloric acid solution (E. Puxeddu, Gazz. Chim. Ital. 48 (II), 25 (1919)), and it has been proposed to add organic solvents, providing for some, but frequently not sufficient improvement in solubility. Moreover, purification and recovery of the solvent pose problems.

Also the U.S. Pat. No. 3,645,864 describes electrolytic reduction in an acid medium. In this case, the starting material is nitrobenzene which is reduced to p-amino phenol and its derivatives at 60° to 150° C. and at a cathode potential of −0.25 to −0.35 V with respect to a saturated calomel electrode.

According to the DE Offenlegungsschrift No. 2 256 003, electrolytic preparation of amino phenols proceeds in a basic medium, the electrolyte solution being an alkali metal hydroxide solution. However, the starting materials are nitrosophenols which must be synthesized beforehand in an inert atmosphere, and to obtain reasonable results it is necessary to use a large number of electrolysis cells in series connection.

In view of polarographic studies (see T. M. Florence, Austr. J. Chem., 18, 609 (1965); T. M. Florence, J. Electroanal. Chem., 52, 115 (1974); H. A. Laitinen & T. J. Kneip, J. Am. Chem. Soc., 78, 736 (1956) and Chem. Abstr. 48, 4333 (1954) the following mechanism has been proposed for the reductive cleavage of p-arylazophenols (here shown with p-phenylzophenol):

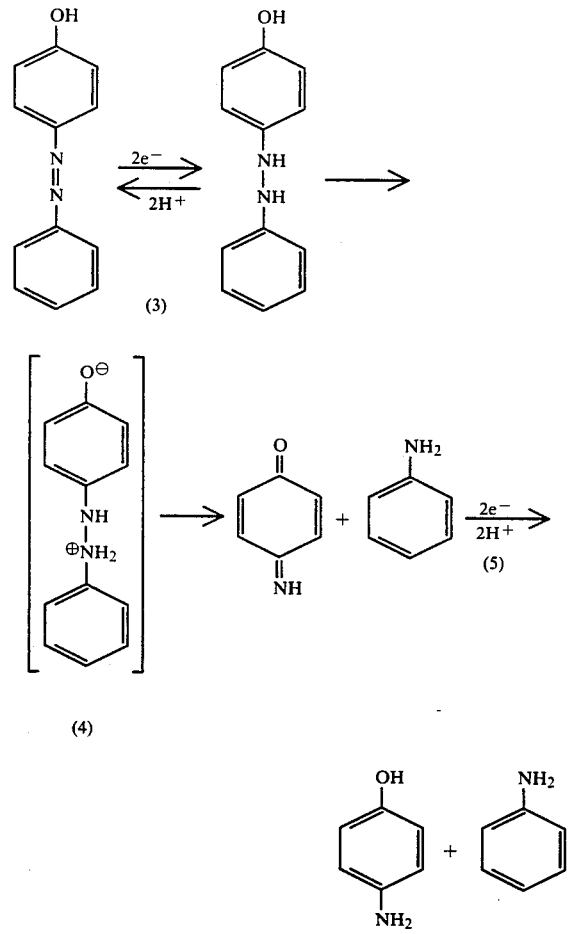

It will be seen that the reaction outlined above involves a total of 4 electrons (n=4). The slow step in the reaction sequence is step (4), and the polarographic results show in fact that the reaction (4) proceeds so slowly in a basic liquid that it cannot be observed at all under such circumstances. Thus, the final step (5) is not observed either, and, in practice, only n=2 is obtained by polarography in a sufficiently basic liquid, for a number of compounds already at pH values of 5.0 and higher. Accordingly, Puxeddu (Gazz. Chim. Ital. 50 (II), 149 (1920)) found no p-amino phenol by reduction of hydroxyazobenzene in a basic liquid.

Some heterocyclic compounds, e.g. 4-pyridylazophenol, can be cleaved by electrolytic reduction in a basic liquid (T. M. Florence, J. Electroanal. Chem., 52, 115 (1974)), the mechanism being presumably as follows (and not as shown on p. 124 in the reference):

$$PyN{=}NArO^- \underset{}{\overset{2e^- + 2H^+}{\rightleftharpoons}} PyNH—NHArO^- \quad (6)$$

-continued $$PyNH^{\oplus}-HN^{\oplus}-Ar^{\ominus}-O^{\ominus} \longrightarrow PyHY^{-} + HN{=}Ar{=}O \quad (7)$$

followed by reaction (5) above. Cleavage (7) proceeds reasonably rapidly because $PyNH^-$ (compared to $C_6H_5NH^-$) is a considerably weaker base. The reason is that the pyridine ring has strong electron attraction so the negative charge is less concentrated on the amine nitrogen. Other strongly electron attracting groups will act in the same manner.

It has now surprisingly been found that it is possible to reduce p-arylazophenols electrolytically at relatively high pH values (pH≧the pKa value of the p-arylazophenol) and suitably high temperatures (preferably of the order of 50° to 100° C.), resulting in an amine and a p-amino phenol. The advantage of using pH values higher than or equal to the pKa values is in particular that the p-arylazophenols are soluble in aqueous media under these circumstances.

Previously, p-arylazophenols were reduced in basic media by chemical methods, e.g. with $Na_2S$ or $Na_2S_2O_4$, see the U.S. Pat. No. 1,882,758. However, the use of chemical reducing agents generally cause environmental problems because e.g. 4 moles of $SO_2$ per mole of product are formed by the use of $Na_2S_2O_4$, and problems may also be attached to the purification. In the electrolytic reduction, in contrast, the "reagent" is electrons which do not give rise to problems of the above-mentioned type. Another point in this connection is the economic aspects since the prices of electricity have risen less than the prices of chemicals in recent years.

The present process can in principle be used for the reduction of all arylazophenols with the single restriction that the phenol group is para-positioned with respect to the azo group. The two substituents $R_1$ and $R_2$ are independently selected from among hydrogen, optionally substituted alkyl groups, halogens, COOH, $SO_3H$ or $NO_2$; the type of the substituents is not critical when only the substituents are not reduced under the given reaction conditions.

The electrolysis is performed in an aqueous basic medium whose pH value is determined by the pKa of the p-arylazophenol used as the starting material. In practice, pH will be 8 to 10 or more, depending upon the starting material. It is believed that the reaction rate increases with increasing pH, so pH>12 is often used. The temprature used is sufficiently high to ensure a reasonable reaction rate. Frequently, this temperature is between 70° and 100° C., at which the reduction proceeds at a reasonably high rate. Temperatures above 100° C. can also be used, but this is no advantage in terms of energy.

Lower temperatures, more particularly down to 50° C., may also be used, but in such cases it is necessary to use lower current densitites, and even though the reaction also proceeds e.g. at room temperature, the reaction rate is so slow that it is not attractive in practice to work at this temperature.

The potential used is up to 0.7 V, preferably about 0.5 V more negative than the reduction potential (halfwave potential) at the given pH value. A more negative potential is not harmful, unless other groups or substances are reduced by this. The potential is not significantly temperature-sensitive. The current intensity used is the current density ($A/dm^2$) multiplied by the electrode area. The current density used depends upon the supply of reducible material, which is a function of concentration and transport conditions (laminar or turbulent flow) in the reactor.

Preferred compounds produced by the process of the invention are p-amino phenol and 5-aminosalicylic acid.

The invention will be illustrated more fully by the following examples.

EXAMPLE 1

Preparation of 5-aminosalicylic acid

A. Preparation of 5-phenolazosalicylic acid 18.6 kg (200 moles) of aniline are dissolved in a mixture of 40 liters of concentrated hydrochloric acid and 45 liters of water with stirring in a container (A). Cooling is effected to 0° C., and a solution of 14 kg of sodium nitrite in 40 liters of water from another container (B) is slowly added with good stirring, so that the temperature does not exceed 2° C. After completed addition, stirring continues for another 15 minutes, and then about 4 kg of anhydrous sodium carbonate are added in minor portions with stirring. Then pH is between 1 and 2.

In a third container (C), 28 kg (202 moles) of salicylic acid are dissolved in 33 liters of concentrated sodium hydroxide solution (500 g of NaOH in 1 liter solution) and 67 liters of water to which 2 kg of anhydrous sodium carbonate have been added. After cooling to 0° C., the contents are pumped slowly from the container (A) and with stirring to a container (C), so that the temperature is kept below 5° C. The azo compound gradually precipitates and finally becomes a thick porridge-like mass. The last part of the coupling proceeds slowly, and it is necessary to stir for 5 or 6 hours after completed addition of the diazo solution from the container (A).

B. Reduction of 5-phenylazosalicylic acid 20 liters of a concentrated sodium hydroxide solution (500 g of NaOH in 1 liter solution) are added to the contents in the container (C), and heating is performed until everything has been dissolved and pH is above 12. Then the contents are pumped into another container (D), followed by heating to 80° C. The contents are pumped through the electrolysis cell, which may be a "filter press cell" (SU Electro Syn Celle) with a lead cathode potential of at least −1.4 V (measured against a standard calomel electrode). The current density is 10 to 20 $A/dm^2$. After 2,000 Ah, the current density is reduced to 2 to 3 $A/dm^2$, and after another 2 hours the electrolysis is stopped. The solution is decolored by addition of 5 kg of sodium hydrosulfite and is pumped into a container (F) blown through with nitrogen.

40 kg of NaOH are dissolved in 250 liters of water in a container (E), and the solution is used as anode liquid. It is important for the life of the anodes that the solution is always strongly basic.

Water steam (optionally superheated steam) is conveyed to the contents in the container (F), and the resulting aniline is distilled off with water steam. Then concentrated hydrochloric acid is added to a pH of 4.1, and cooling is effected to 0° to 5° C. with stirring. After a couple of hours the crystallization has terminated, and the resulting 5-aminosalicylic acid is isolated by centrifugation or in a filter press. Yield: Approximately 28 kg of a sligtly coloured substance which is purified by recrystallization from water followed by decoloration with active carbon.

EXAMPLES 2–7

The electrolytic preparation of 5-aminosalicylic acid is examined under various conditions in these examples. 0.4 mole of 5-phenylazosalicylic acid is used for each electrolysis and is prepared as follows:

74.5 g of redistilled aniline are dissolved with stirring in a mixture of 160 ml of concentrated hydrochloric acid and 180 ml of demineralized water, and cooling is effected to 0° C. in an ice/salt bath. 56 g of $NaNO_2$ dissolved in 160 ml of demineralized water and cooled to 0° C. are slowly added with stirring to the aniline hydrochloride solution, so that the temperature does not exceed 2° C. After completed addition the pH is 1.0 to 1.5.

112 g of salicylic acid are dissolved with stirring in a mixture of 132 ml of concentrated NaOH (500 g in 1 liter solution) and 268 ml of $H_2O$.

After cooling to 0° C., the diazo compound is added slowly and with stirring, so that the temperature does not exceed 5° C. The resulting coupling product is a viscous mass which is stirred overnight.

The resulting azo compound (0.8 mole) is admixed with a mixture of concentrated NaOH and water to dissolve the coupling product before the electrolysis. The pH value hereby exceeds 12. The produced amount of azo compound is sufficient for two electrolyses.

Half of the solution (corresponding to 0.4 mole of 5-phenylazosalicylic acid) is poured into the cathode compartment of the electrolysis cell. An NaOH solution is poured into the anode compartment. The contents are pumped through the electrolysis cell, and the reaction is started. When the electrolysis has terminated, the reduction product is tapped into a flask. Cooling is effected, and HCl is added to pH 4.0. After filtration the residue (5-aminosalicylic acid) is washed in $H_2O$ and acetone.

The electrolysis is performed in a conventional electrolysis cell in which the anode compartment and the cathode compartment are separated by a semi-permeable membrane. The cathode is of lead, and the anode is of nickle. The cathode reference electrode is an Ag/AgCl electrode.

The reference voltage must be greater than 0.8 V, which is the natural potential of the Ag/AgCl electrode. A reference voltage below this value means that there will be no reduction. The reference voltage should be as close to 1.5 V as possible and be maintained at that value in order fo the reduction to proceed satisfactorily.

The electrolysis conditions used are set forth in the following table. Also the yield of crude 5-aminosalicylic acid obtained by each electrolysis appears from the table.

| Ex. No. | Addition to 0.8 mole coupling compound | Electrolysis temperature | Anode liquid | Membrane | Voltage anode cathode | Reference voltage cathode | Current intensity | Total Electrolysis current | Yield Crude product (% of theory) |
|---|---|---|---|---|---|---|---|---|---|
| 2 | 2 moles NaOH in 200 ml $H_2O$ | 60° C. | 8 moles NaOH in 2 l $H_2O$ | a | constant 6 V | app. 1.2 V | 3–4 A | 48 Ah | 86 |
| 3 | 2 moles NaOH in 200 ml $H_2O$ | 70° C. | 8 moles NaOH in 2 l $H_2O$ | a | constant 6 V | 1.2–1.3 V | 5 A | 59 Ah | 85 |
| 4 | 2 moles NaOH in 200 ml $H_2O$ | 70° C. | 8 moles NaOH in 2 l $H_2O$ | b | constant 6 V | 1.3–1.45 V | 8.7 A | 52 Ah | 79 |
| 5 | 1 mole NaOH in 200 ml $H_2O$ | 70° C. | 8 moles NaOH in 2 l $H_2O$ | b | constant 6 V | 1.25–1.4 V | 8A | 47 Ah | 75 |
| 6 | 2 moles NaOH in 200 ml $H_2O$ | 70° C. | 8 moles NaOH in 2 l $H_2O$ | c | constant 6 V | 1.4–1.6 V | 7.8 A | 47 Ah | 75 |
| 7 | 1.5 moles NaOH in 200 ml $H_2O$ | 80° C. | 8 moles NaOH in 1 l $H_2O$ | d | constant 6 V | 1.3–1.5 V | 7.0 A | 60 Ah | 72 |

a "mc" 3470 from Sybron Chemical
b "Nafion ®" 324
c "Nafion ®" 423
d a "Nafion ®" membrane.

In example 2, owing to the relatively low temperature of 60° C., the reference voltage has only just reached 1.2 V (however not all the time). This involves an inferior reaction process, and the reaction should therefore proceed at a temperature of at least 70° C. The high yield of production in example 2 is probably due to the relatively great unreliability associated with the test because the substance quantities involved are very small.

EXAMPLE 8

Preparation of p-amino phenol

In an H-cell (see H. Lund; "Practical Problems in Electrolysis" in "Organic Electrochemistry", 2nd ed., edited by M. M. Baizer and H. Lund, Marcel Dekker, New York 1983, p. 168) consisting of two 250 ml conical flasks connected through a semi-permeable membrane ("Nafion" ®) and equipped with a mercury cathode and a carbon anode, the cathode compartment is filled with a solution of 10 g of p-hydroxyazobenzene in 150 ml 0.2M sodium hydroxide, with pH exceeding 12, and the anode compartment is filled with 0.5M sodium hydroxide. The cathode compartment is provided with a thermometer and a reflux condenser. Venting with nitrogen, and a nitrogen atmosphere is maintained in the cathode compartment during the entire reduction. The temperature is increased to 80° C., and electrolysis is performed at −1.2 V, measured against a standard calomel electrode, with stirring with a magnet stirrer. The initial current density is about 10 A/dm$^2$. This gradually decreases, and the solution changes from being opaque to be just slightly coloured (pale brown). The reflux condenser is replaced by a distillation device, and most of the resulting aniline is distilled off, the temperature being increased to about 100° C. The flow of nitrogen and water steam transfers the aniline into the collecting flask.

The cathode liquid is cooled and neutralized to ph about 6.5. After standing at 0° C., 4.6 g (84%) of p-amino phenol are filtered off as slightly pale brown crystals.

EXAMPLE 9

Preparation of 2-chloro-3-amino phenol 10 g of 4-phenylazo-2-chlorophenol are reduced in the same manner as in example 8. The yield is 5.4 g (86%) of 2-chloro-4-amino phenol with a melting point of 153° C.

I claim:

1. A process for preparing p-amino phenols of the general formula

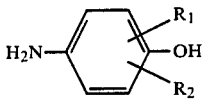

(I)

wherein $R_1$ and $R_2$ are independently hydrogen, optionally substituted alkyl, halogen, COOH, $SO_3H$ or $NO_2$, by electrolytic reduction of p-phenylazophenols of the formula

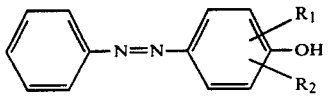

(II)

wherein $R_1$ and $R_2$ are as defined above, in an aqueous medium, characterized by performing the electrolysis in a basic medium at a pH value at least equal to the pKa value of the p-phenylazophenol and at an elevated temperature of at least 50° C., preferably about 70° to 100° C.

2. A process according to claim 1, characterized in that the resulting compound is 5-aminosalicylic acid.

3. A process according to claim 1, characterized in that the resulting compound is p-amino phenol.

4. A process according to claim 1, characterized in that the resulting compound is 2-chloro-4-amino phenol.

5. A process according to claim 1, characterized in that pH exceeds 12.

6. A process according to claim 1, characterized in that the potential is between 0.1 and 0.7 V more negative than the halfwave potential of the compound which is being reduced, at the pH value used.

* * * * *